US006368085B1

(12) United States Patent
Collings

(10) Patent No.: US 6,368,085 B1
(45) Date of Patent: Apr. 9, 2002

(54) SUCTION VALVE WITH VARIABLE SLOT WIDTH

(75) Inventor: Douglas A. Collings, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/694,495

(22) Filed: Oct. 23, 2000

(51) Int. Cl.[7] ..... F04B 39/10
(52) U.S. Cl. ..... 417/569; 417/571
(58) Field of Search ..... 417/569, 571, 417/447

(56) References Cited

U.S. PATENT DOCUMENTS

| | | | | |
|---|---|---|---|---|
| 2,151,746 A | | 3/1939 | Cody | |
| 4,642,037 A | | 2/1987 | Fritchman | |
| 4,764,091 A | | 8/1988 | Ikeda et al. | |
| 4,867,650 A | | 9/1989 | Ikeda et al. | |
| 5,110,272 A | * | 5/1992 | Peruzzi et al. | 417/571 |
| 5,140,748 A | | 8/1992 | Kandpal | |
| 5,147,190 A | | 9/1992 | Hovarter | |
| 5,197,867 A | | 3/1993 | Kandpal | |
| 5,209,260 A | * | 5/1993 | Baek | 137/527 |
| 5,266,016 A | * | 11/1993 | Kandpal | 417/569 |
| 5,454,397 A | | 10/1995 | Miszczak | |
| 5,558,508 A | | 9/1996 | Sasano et al. | |
| 5,609,476 A | * | 3/1997 | Kim et al. | 417/447 |
| 5,722,818 A | | 3/1998 | Ohta et al. | |
| 5,934,305 A | * | 8/1999 | Cho | 137/15.18 |
| 6,227,825 B1 | * | 5/2001 | Vay | 417/569 |
| 6,293,774 B1 | * | 9/2001 | Brabek | 417/569 |

* cited by examiner

*Primary Examiner*—Teresa Walberg
*Assistant Examiner*—Vinod D. Patel
(74) *Attorney, Agent, or Firm*—Baker & Daniels

(57) ABSTRACT

A reciprocating piston compressor is provided, including a crankcase having a cylinder, the cylinder having an opening in an exterior surface of the crankcase. A valve assembly including a suction leaf plate covers the cylinder opening. A flexible suction leaf valve is defined by a slot in the suction leaf plate, and the suction leaf valve includes a base integral with the suction leaf plate and a tip opposite the base. The slot has a width which is reduced from a maximum distance at the base to a minimum distance at the tip.

23 Claims, 5 Drawing Sheets

SUCTION VALVE WITH VARIABLE SLOT WIDTH

BACKGROUND OF THE INVENTION

1. Field of the Invention

The present invention relates generally to reciprocating piston compressors for compressing fluid, and particularly to a suction leaf plate for the valve assembly of such compressors.

2. Description of the Related Art

Suction leaf plates having slots therein which define the suction leaf valves comprise part of the valve assembly of a reciprocating piston compressor. The suction leaf plate is disposed over an opening of a cylinder, between the cylinder and a valve plate. The suction leaf valve, also known as a reed or "flapper" valve, includes a cantilevered head or free end which is forced away from the valve plate to admit fluid into the cylinder through a suction port provided in the valve plate during the intake stroke of a piston in the cylinder.

Suction leaf valves are formed by stamping a slot in a suction leaf plate using a die apparatus, the suction leaf plate made of thin valve steel. Known suction leaf valves are formed by stamping a slot of uniform width in the suction leaf plate, the slot is desirably as narrow as possible to reduce the volume of fluid contained within the slot. If overly large, this volume, commonly called re-expansion volume, reduces the efficiency of the compressor, because the fluid within the volume is repeatedly being compressed and expanded without producing any benefit. Therefore, the narrower the slot between the suction leaf valve and the surrounding portion of the suction leaf plate, the smaller the re-expansion volume.

A problem with such narrow slots is associated with the finishing process of the suction leaf valve, known as "deburring". During the deburring process, sharp metal burrs around the edges of the slot, which results from the stamping process, are removed by placing the suction leaf plates in a tumbler along with an abrasive media. The tumbler is then rotated such that the abrasive media may enter the slot and frictionally engage the edges around the slot to remove any sharp burrs or sharp edges.

The problem with a suction leaf valve having a uniform slot width is that, because the suction leaf valve may flex to a greater extent near the tip of its free end than at its base portion during tumbling, the abrasive media may more easily enter the slot to finish the edges of the slot toward the head of the suction leaf valve than the edges of the slot toward the base of the suction leaf valve. This results in the edges of the slot around the head of the suction leaf valve becoming over finished, and the edges of the slot around the base of the suction leaf valve remaining under finished.

A problem with over finishing is that the edges of the suction leaf valve and suction leaf plate around the slot include broadly sloping surfaces terminating in sharp knife edges. The sharp knife edges are easily dented or cracked upon contact with one another or other objects prior to installation of the valve, and the crack may propagate across the width of the valve to result in failure of the valve. A problem with under finishing is that the sharp burr edges are not removed. The burr edges, similar to the knife edges, may contact one another or other objects prior to installation of the valve, resulting in cracks or dents which may propagate across the width of the valve and result in valve failure during operation of the compressor.

What is needed is a suction leaf valve defined by a narrow slot around the head portion of the valve to minimize re-expansion volume and which allows abrasive media to uniformly enter therethrough, resulting in a uniform finish around the edges of the suction leaf valve and suction leaf plate.

SUMMARY OF THE INVENTION

The present invention provides a suction leaf plate for a reciprocating piston compressor, the suction leaf plate having a slot defining a suction leaf valve therein, the slot having a variable width.

The width of the slot in the suction valve plate may be reduced from a maximum at the base portion of the suction leaf valve to a minimum at the tip of the suction leaf valve. The slot in the suction leaf plate may also be characterized as having a width which narrows toward the tip of the suction leaf valve with increasing chordal distances from a point of maximum flex stress on the suction leaf valve to a plurality of points along an edge of the suction leaf valve.

The slot may further include a cutaway portion in the suction leaf plate defining a discharge gas opening, and the slot may terminate in a pair of cutaway lobes disposed on opposite sides of the base of the suction leaf valve, about which the suction leaf valve may flex. The suction leaf valve may be shaped to include a rounded head portion with a tip disposed opposite the base, and a narrowing waist portion extending laterally across the valve between the head portion and the base.

In addition, the width of the slot may be fine-tuned empirically by first stamping a variable width slot in a suction leaf plate, deburring the suction leaf plate, and inspecting the edges of the slot for burr edges and/or knife edges. If burr edges and/or knife edges are found, the slot is modified such that the width of the slot is narrowed at the location of the knife edges and widened at the location of the burr edges, resulting in a modified slot where the edges of the suction leaf valve and suction leaf plate after deburring having a substantially uniform finish, without burr edges and/or knife edges.

In one form thereof, the present invention provides a reciprocating piston compressor, including a crankcase having a cylinder, the cylinder having an opening in an exterior surface of the crankcase; a piston reciprocatingly disposed in the cylinder; a valve assembly including a suction leaf plate, the suction leaf plate covering the cylinder opening; and a suction leaf valve defined by a slot in the suction leaf plate, the suction leaf valve including a base integral with the suction leaf plate, and a tip opposite the base, the slot having a width is reduced from a maximum distance at the base to a minimum distance at the tip.

In another form thereof, the present invention provides a reciprocating piston compressor, including a crankcase having a cylinder with an opening in an exterior surface of the crankcase; a piston reciprocatingly disposed in the cylinder; a valve assembly mounted to the crankcase exterior surface and covering the cylinder opening, the valve assembly including a suction leaf plate; a suction leaf valve defined by a slot in the suction leaf plate, the suction leaf valve having a base portion integral with the suction leaf plate about which the suction leaf valve may flex, and a head portion including a tip located opposite the base portion; a point of maximum flex stress disposed along an edge of the suction leaf valve, the edge defined by the slot; and the slot having a varying width which narrows toward the tip with increasing chordal distances from the point of maximum flex stress to a plurality of points along the edge.

In a further form thereof, the present invention provides a method for manufacturing a reciprocating piston compressor having a crankcase and a cylinder assembly with a cylinder opening, including the steps of providing a suction leaf plate; producing in the suction leaf plate a slot defining a suction leaf valve, the suction leaf valve including a base integral with the suction leaf plate and a tip opposite the base, the slot having a width reducing from a maximum at the base to a minimum at the tip, the slot further defining edges on the suction leaf valve and the suction leaf plate around the slot; tumbling the suction leaf plate in an abrasive media to produce a substantially uniform finish around the edges; and attaching the suction leaf plate to the crankcase and the cylinder assembly to cover the cylinder opening.

In a still further form thereof, the present invention provides a method for manufacturing a suction leaf plate for a reciprocating piston compressor, including the steps of providing a steel plate; producing a slot in the steel plate to form a suction leaf plate, the slot defining a suction leaf valve having a base integral with the suction leaf plate, a tip opposite the base, and edges on the suction leaf valve and the suction leaf plate around the slot, the slot having a width narrowing from a maximum at the base to a minimum at the tip; and tumbling the suction leaf plate in abrasive media to produce a substantially uniform finish around the edges.

An advantage of the present invention is that the width of the slot is relatively narrow around the head portion of the valve to minimize re-expansion volume, yet is relatively wider around the base portion of the valve to permit proper finishing, such that the edges of the suction leaf valve and suction leaf plate have a substantially uniform finish.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION

Figure 1:
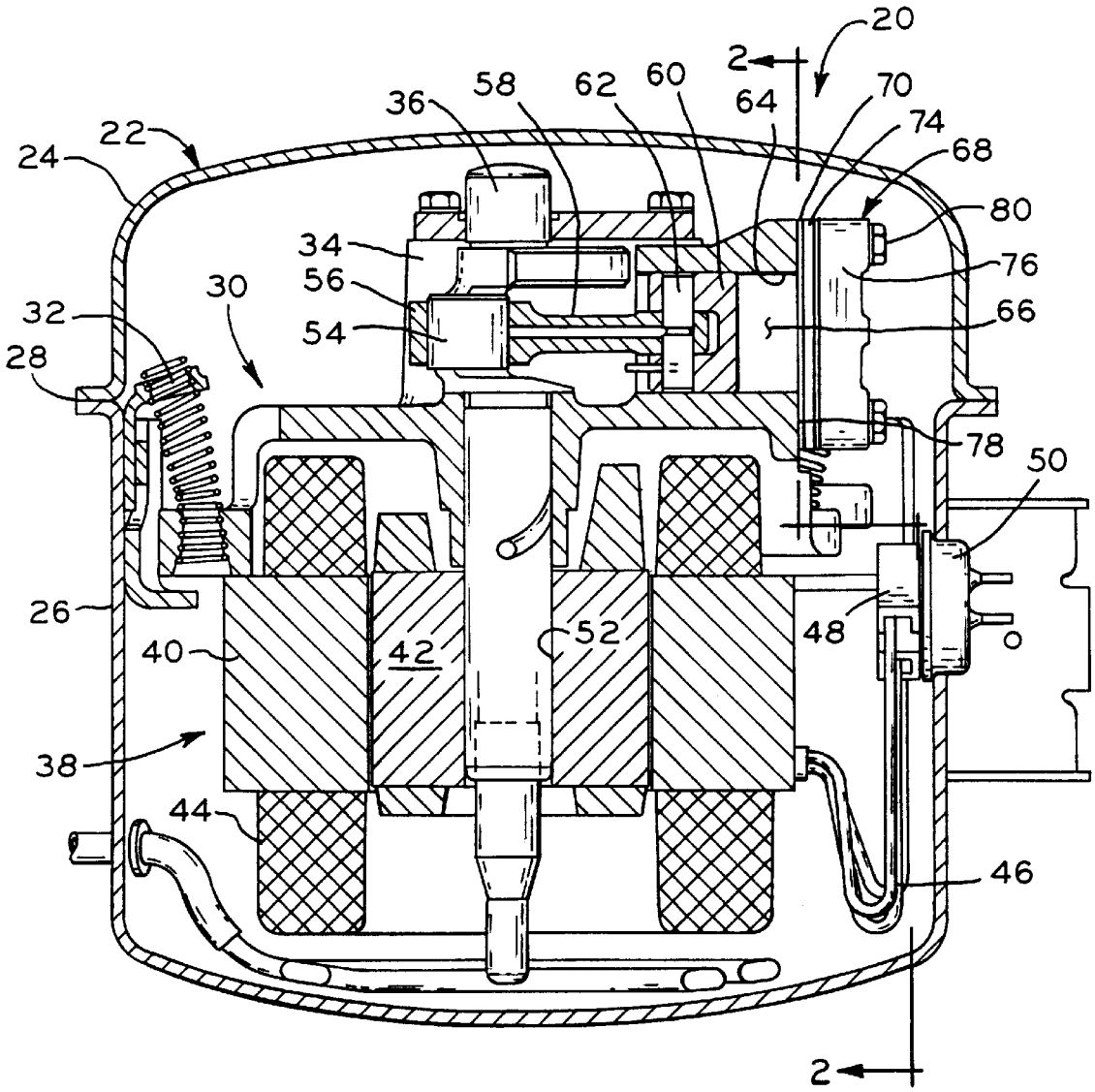
FIG. 1 is a longitudinal sectional view of a reciprocating piston compressor according to the present invention.
Figure 2:
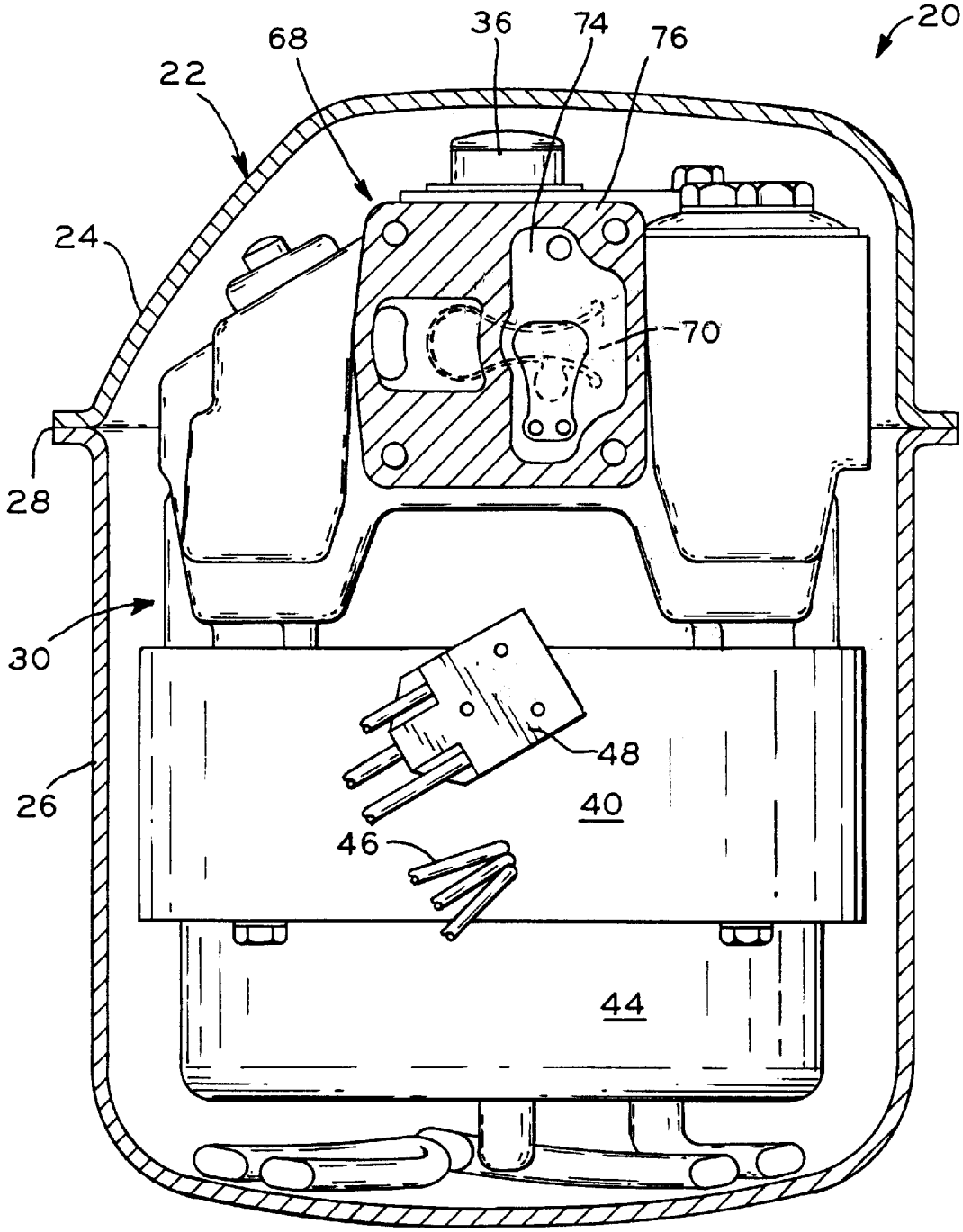
FIG. 2 is a sectional view of the compressor of FIG. 1 along line 2—2.

Referring to FIGS. 1 and 2, there is shown hermetic compressor 20 for compressing a gas such as air or a refrigerant. Compressor 20 includes housing 22 having an upper portion 24 and a lower portion 26, which are sealingly secured together at seam 28, in a conventional manner, such as by welding. A motor-compressor unit 30 is resiliently mounted within housing 22 by means of a plurality of circumferentially spaced mounting assemblies 32.

Motor-compressor unit 30 includes crankcase 34 having crankshaft 36 rotatably received therein, and electric motor 38 comprising stator 40 and rotor 42. Stator 40 is provided with windings 44, which are connected to an external current source by means of electrical leads 46, terminal block 48, and hermetic terminal 50 in the usual way. Rotor 42 has a central aperture 52 provided therein into which crankshaft 36 is secured by an interference fit.

Crankshaft 36 includes eccentric portion 54 which is received in a closed loop end 56 of connecting rod 58. Connecting rod 58 is also connected to piston 60 by means of wrist pin 62. Crankcase 34 includes cylinder bore 64, defined by cylinder sidewall 66, in which piston 60 reciprocates. Cylinder 64 is covered by valve assembly 68. Valve assembly 68 includes suction leaf plate 70 disposed over cylinder opening 72, valve plate assembly 74 disposed over suction leaf plate 70, and cylinder head 76 disposed over valve plate assembly 74. Valve plate assembly 74 may include an attached discharge valve (not shown). Valve assembly 68 is attached to exterior surface 78 of crankcase 34 by bolts 80 extending through bolt holes 82 in suction leaf plate 70 (FIG. 5), valve plate assembly 74, and cylinder head 76. Suction leaf plate 70 is usually made of a thin, high quality valve steel.

Figure 3:
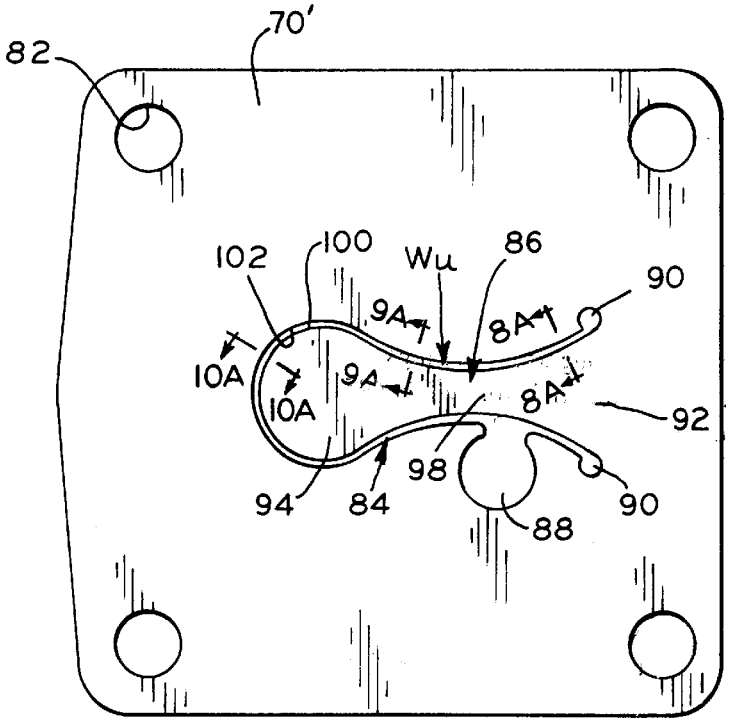
FIG 3 PRIOR ART
FIG. 3 is a plan view of a previous suction leaf plate having a slot of uniform width defining a suction leaf valve therein.

Referring to FIG. 3, a previous suction leaf plate 70' is shown. Suction leaf plate 70' includes bolt holes 82, and slot 84 having a substantially uniform width $W_u$ around suction leaf valve 86 to define suction leaf valve 86. Slot 84 is stamped out of suction leaf plate 70' by means of a die apparatus, and may be made as narrow as possible to minimize the re-expansion volume contained in slot 84 between piston 60 and valve plate assembly 74. Generally, the re-expansion volume decreases the efficiency of compressor 20 because work must be performed to compress the fluid in the re-expansion volume, yet no system work is gained because the fluid does not leave the cylinder.

Slot 84 also includes a cutaway portion 88 defining a discharge fluid opening. Slot 84 terminates in a further pair of cutaway lobe portions 90 at opposite sides of base 92 of suction leaf valve 86. Suction leaf valve 86 includes head portion 94 having tip 96 disposed opposite base 92, and a narrow waist portion 98 disposed between head portion 94 and base 92. Suction leaf valve 86 may flex at base 92. A problem with the uniform width of slot 84 is that edges 100, 102, of suction leaf valve 86 and suction leaf plate 70, respectively, are not uniformly finished during deburring, as explained below.

Figure 4:
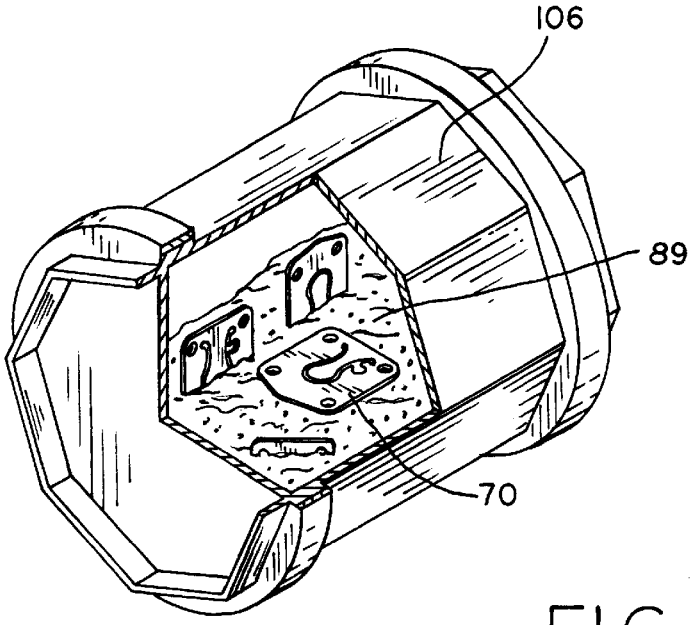
FIG. 4 is a perspective, cutaway view of a deburring tumbler having abrasive media and suction leaf plates therein.

Deburring is a process of removing sharp metal burr edges along edges 100, 102 of suction leaf valve 86 and suction leaf plate 70, respectively, around slot 84. Suction leaf plate 70 is placed within tumbler 106, such as that shown in FIG. 4. Also placed within tumbler 106 is abrasive media 89 to wear down the sharp burr edges 104 around slot 84. Abrasive media 89 may be sand, ceramic media, or another suitable, substantially granular media.

Generally, suction leaf valve 86 flexes away from suction leaf plate 70 to a much greater extent near valve head portion 94 than near valve base 92, and therefore abrasive media 89 may enter slot 84 between suction leaf valve 86 and suction leaf plate 70 more readily around head portion 94 than around base 92. Consequently, edges 100, 102, are finished to a much greater extent around head portion 94 than around base 92 during deburring.

Therefore, increasing the width of slot 84 allows abrasive media 89 to enter slot 84 during deburring such that edges 100, 102 are finished to a greater extent. However, as described above, the re-expansion volume also increases with the width of slot 84. It may be understood from the foregoing that in previous suction leaf plates 70', there is a conflicting trade-off between widening slot 84 to allow for finishing where re-expansion volume increases, and narrowing slot 84 to minimize re-expansion volume where finishing is inhibited.

Figure 8A:
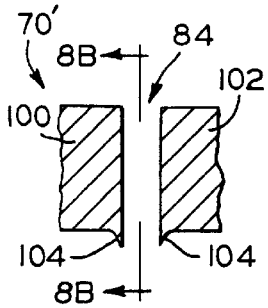
FIG 8A PRIOR ART
FIG. 8A is a partial cross sectional view taken along line 8A—8A of FIGS. 3 and 7 showing an underfinished valve.

FIGS. 8A, 8B, 9A, 9B, 10A and 10B show various degrees or stages of finishing on edges 100, 102 of suction leaf valve 86 and suction leaf plate 70, respectively, around slot 84. FIG. 8A shows edges 100, 102 in a substantially unfinished or underfinished state, where edges 100, 102 still include sharp burr edges 104 produced when slot 84 is stamped from suction leaf plate 70. Disadvantageously, edges 100, 102 have burrs 104 which may contact one another or other objects, such as during deburring or during the assembly of valve assembly 68, and split to form cracks or stress fractures which propagate along the width of suction leaf valve 86 during operation of compressor 20, causing suction leaf valve 86 to fail.

Figure 9A:
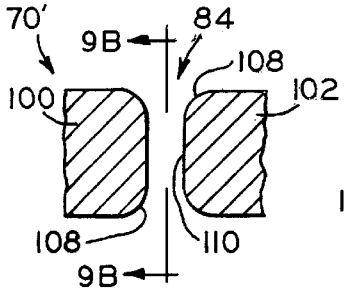
FIG 9A PRIOR ART
FIG. 9A is a partial cross sectional view taken along line 9B—9B of FIGS. 3, 5, and 7 showing a properly finished valve.
Figure 10A:
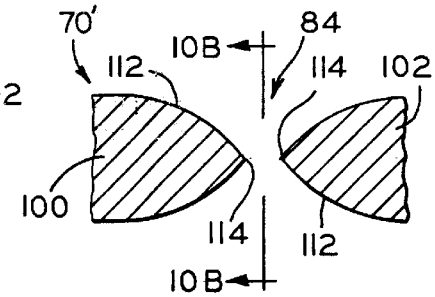
FIG 10A PRIOR ART
FIG. 10A is a partial cross sectional view taken along line 10B—10B of FIGS. 3 and 7 showing an overfinished valve.
Figure 8B:
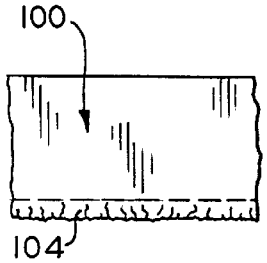
FIG 8B PRIOR ART
FIG. 8B is an elevational view along line 8B—8B of FIG. 8A.

FIG. 9A shows a desired proper finish, where edges 100, 102 each include arcuate, smoothly rounded surfaces 108 having an arc profile, with arc lengths shorter than the relatively longer arc lengths of sloping surfaces 112 shown in FIG. 10A. Rounded surfaces 108 are connected by smooth planar face 110 disposed between rounded surfaces 108. As may be seen from FIGS. 9A and 9B, edges 100, 102, rounded surfaces 108 and planar faces 110 present a uniform, smooth surface resistant to cracks or stress fractures.

Figure 10B:
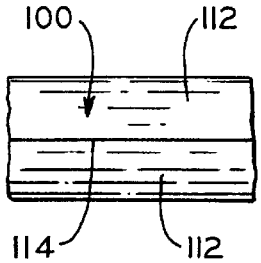
FIG 10B PRIOR ART
FIG. 10B is an elevational view along line 10B—10B of FIG. 10A.

FIGS. 10A and 10B show edges 100, 102 which are overfinished, such that edges 100, 102 include broad, sloping surfaces 112 having an arc profile, with arc lengths relatively longer than the arc lengths of rounded surfaces 108 shown in FIG. 9A. Sloping surfaces 112 terminate in knife edges 114. Knife edges 114 are easily dented or broken upon contact with one another or other objects, resulting in cracks or stress fractures which may propagate across the width of suction leaf valve 86 during operation of compressor 20, leading to valve failure.

Figure 9B:
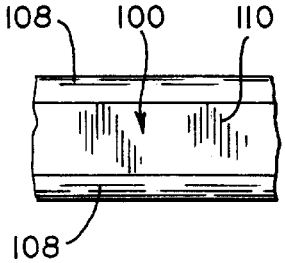
FIG 9B PRIOR ART
FIG. 9B is an elevational view along line 9B—9B of FIG. 9A.

Referring again to FIG. 3, it may be seen that, due to the uniform width of slot 84, after deburring, edges 100, 102 tend to become underfinished near base 92, properly finished around waist 98, and overfinished around head portion 94, such that edges 100, 102 are not uniformly finished to have the desired finish shown in FIGS. 9A and 9B.

Figure 5:
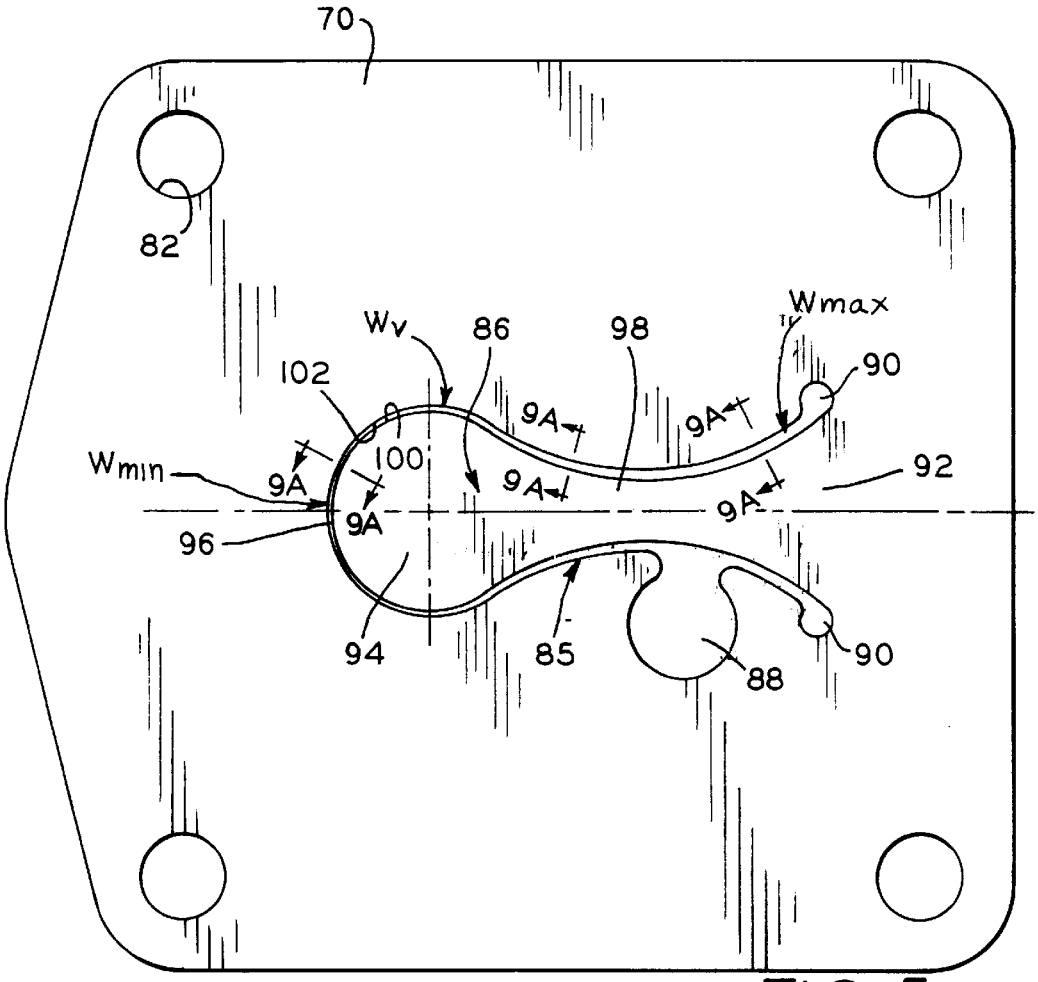
FIG. 5 is a plan view of a suction leaf plate having a slot of variable width therein defining a suction leaf valve.

Now, referring to FIG. 5, suction leaf plate 70 in accordance with the present invention is shown, which includes bolt hole 82, and slot 85 having a variable width $W_v$ around suction leaf valve 86 to define suction leaf valve 86. Variable width slot 85 also includes a cutaway portion 88 defining a discharge fluid opening, and terminates in a further pair of cutaway lobe portions 90 at opposite sides of base 92 of suction leaf valve 86, about which suction leaf valve 86 may flex. Suction leaf valve 86 includes head portion 94 with tip 96 opposite base 92, and a narrow waist portion 98 which extends laterally across the valve and is disposed between head portion 94 and base 92.

FIG. 5 illustrates a first way of characterizing width $W_v$ of variable width slot 85, wherein it may be seen from FIG. 5 that slot 85 has a width which is at a maximum $W_{max}$ a near base 92 of suction leaf valve 86, and which continuously reduces or narrows toward head portion 94 to a minimum $W_{min}$ at tip 96. For example, $W_{min}$ may be approximately 0.001 inches, and $W_{max}$ may be approximately 0.030 inches or greater.

Figure 6:
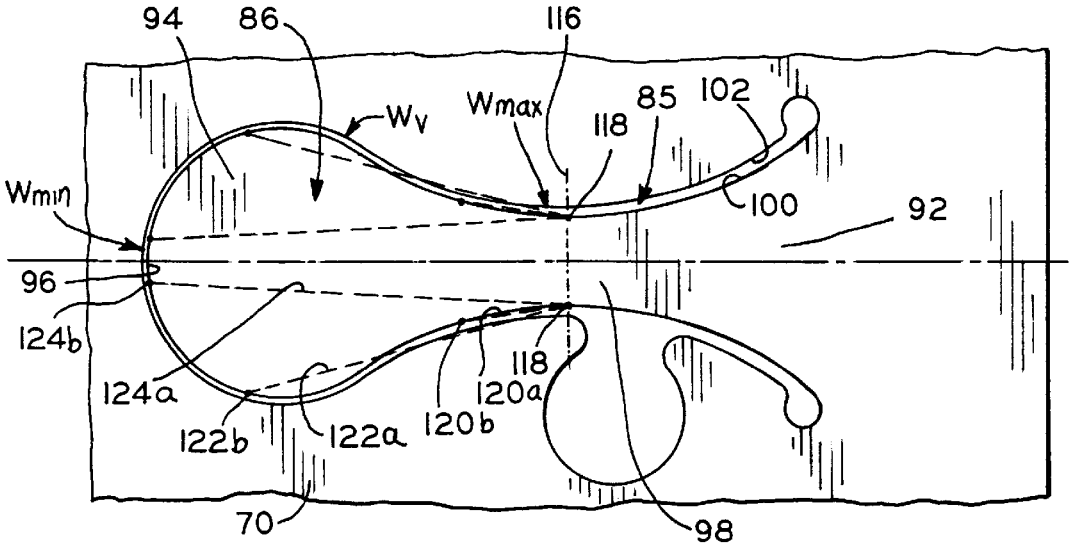
FIG. 6 is an enlarged fragmentary view of a suction leaf plate having a slot of variable width therein defining a suction valve.

Alternatively, FIG. 6 illustrates a second way of characterizing width $W_v$ of variable width slot 85. Suction leaf valve 86 is stressed upon flexing about base 92 during operation of compressor 20. This stress is generally distributed on an area of suction leaf valve 86 between waist portion 98 and base 92, but is greatest across stress line 116 extending across the width of waist portion 98. A pair of maximum stress points 118 are located along stress line 116 at edge 100 of suction leaf valve 86. As shown in FIG. 6, the width of variable width slot 85 continuously decreases from a maximum $W_{max}$ near maximum stress points 118 with increasing chordal distances from maximum stress points 118 along chord lines 120*a*, 122*a*, 124*a* through a plurality of points 120*b*, 122*b*, 124*b* along edge 100 to a minimum $W_{min}$ near tip 96.

Advantageously, as shown in FIGS. 5 and 6, because variable width slot 85 is relatively wide at base 92 and relatively narrow around head portion 94, re-expansion volume is minimized while proper finishing of edges 100, 102 is also facilitated. Re-expansion volume is minimized due to the fact that variable width slot 85 is very narrow around head portion 94 of suction leaf valve 86. Proper finishing is facilitated because abrasive media 89 may more easily enter through the relatively wide area of variable width slot 85 around base 92, about which suction leaf valve 86 flexes to a lesser extent. At the same time, suction leaf valve 86 may flex to a greater extent around head portion 94, thus allowing abrasive media 89 to easily enter variable width slot 85 around head portion 94 such that variable width slot 85 may be relatively narrow at that location.

Therefore, referring to FIG. 5, after stamping slot 85 in suction leaf plate 70 and deburring suction leaf plate 70 in tumbler 106, a substantially uniform finish is produced. Edges 100, 102 each have the desired finish uniformly around the entire distance of variable width slot 85 as shown in FIGS. 9A and 9B, specifically, rounded surfaces 108 connected by planar faces 110. Suction leaf plate 74 may then be attached to crankcase 34 as part of valve assembly 68 during the assembly of compressor 20.

Figure 7:
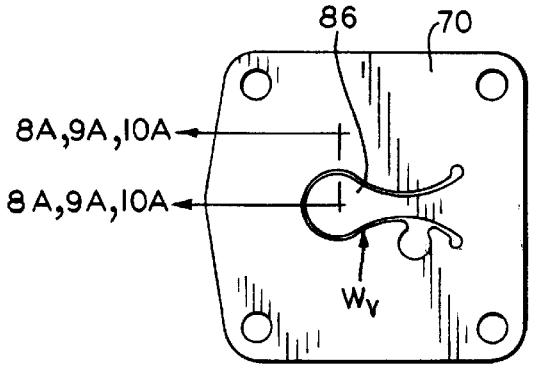
FIG. 7 is a plan view of a suction leaf plate having a slot of variable width therein defining a suction leaf valve.

Additionally, the width of variable width slot 85 may be empirically fine-tuned based on the particular valve steel or stamping method used to produce variable width slot 85. In this connection, a variable width slot 85, such as those described above with reference to FIGS. 5 and 6, is stamped in a suction leaf plate 70, as shown in FIG. 7. The suction leaf plate 70 is then deburred in tumbler 106, and following deburring, edges 100, 102 are inspected for the desired finish (FIGS. 9A and 9B), as well as burr edges (FIGS. 8A and 8B), indicating underfinishing, and knife edges (FIGS. 10A and 10B), indicating overfinishing. To achieve the desired finish described above, the shape of slot 85 may be modified such that portions thereof are selectively widened at locations where burr edges were observed on the first slot, and selectively narrowed at locations where knife edges were observed on the first slot. A substitute suction leaf plate having the modified slot stamped therein is then deburred in tumbler 106, and the above process may then be repeated until a suction leaf plate is produced having edges 100, 102 with the desired uniform finish as described above and shown in FIGS. 9A and 9B.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reciprocating piston compressor, comprising:

a crankcase including a cylinder, said cylinder having an opening in an exterior surface of said crankcase;

a piston reciprocatingly disposed in said cylinder;

a valve assembly including a suction leaf plate, said suction leaf plate covering said cylinder opening; and a flexible suction leaf valve defined by a slot in said suction leaf plate, said suction leaf valve including a base integral with said suction leaf plate, and a tip opposite said base, said slot having a width which is reduced from a maximum distance at said base to a minimum distance at said tip.

2. The compressor of claim 1, wherein said width is continuously reduced from said base to said tip.

3. The compressor of claim 1, wherein said slot defines an edge around each of said suction leaf plate and said suction leaf valve on opposite sides of said slot, each of said edges having a pair of rounded surfaces connected by a planar face.

4. The compressor of claim 3, wherein said suction leaf plate further includes a cutaway portion communicating with said slot and defining a discharge gas opening in said suction leaf plate.

5. The compressor of claim 4, wherein said slot terminates in a pair of cutaway lobes, said base disposed between said lobes.

6. The compressor of claim 5, wherein said suction leaf valve includes a rounded head portion including said tip, and a waist portion between said head portion and said base, said head portion having a width extending laterally across said valve, said waist portion having a width extending laterally across said valve which is smaller than said head width.

7. A reciprocating piston compressor, comprising:

a crankcase including a cylinder, said cylinder having an opening in an exterior surface of said crankcase;

a piston reciprocatingly disposed in said cylinder;

a valve assembly mounted to said crankcase exterior surface and covering said cylinder opening, said valve assembly including a suction leaf plate;

a suction leaf valve defined by a slot in said suction leaf plate, said suction leaf valve having a base portion integral with said suction leaf plate about which said suction leaf valve may flex, and a head portion including a tip located opposite said base portion;

a point of maximum flex stress disposed along an edge of said suction leaf valve, said edge defied by said slot; and said slot having a varying width which narrows toward said tip with increasing chordal distances from said point of maximum flex stress to one of a plurality of points along said edge.

8. The compressor of claim 7, wherein said slot width continuously narrows toward said tip with increasing chordal distances from said point of maximum flex stress to a said one of said plurality of points.

9. The compressor of claim 8, wherein said slot defines edges around each of said suction leaf plate and said suction leaf valve on opposite sides of said slot, each of said edges having a pair of rounded surfaces connected by a planar face.

10. The compressor of claim 9, wherein said suction leaf plate further includes a cutaway portion communicating with said slot and defining a discharge gas opening, and a pair of cutaway lobe portions, said base disposed between said lobes.

11. The compressor of claim 10, wherein said suction leaf valve includes a waist portion located between said head portion and said base, said head portion having a width extending laterally across said valve, said waist portion having a width extending laterally across said valve which is smaller than said head width.

12. A method for manufacturing a reciprocating piston compressor having a crankcase and a cylinder assembly with a cylinder opening, including the steps of:

providing a suction leaf plate;

producing in the suction leaf plate a slot defining a suction leaf valve, the suction leaf valve including a base integral with the suction leaf plate and a tip opposite said base, the slot having a varying width reducing from a maximum at the base to a minimum at the tip, the slot further defining edges on the suction leaf valve and the suction leaf plate around the slot;

tumbling the suction leaf plate in abrasive media to produce a substantially uniform finish around the edges; and attaching the suction leaf plate to the crankcase and cylinder assembly to cover the cylinder opening.

13. The method of claim 12, wherein said width is continuously reduced from said base to said tip.

14. The method of claim 12, wherein the substantially uniform finish around the edges is such that each of the edges has a pair of rounded surfaces connected by a planar face.

15. The method of claim 14, further comprising, if the suction leaf plate does not have the substantially uniform finish around the edges, performing the following additional steps before the suction leaf plate is attached to the crankcase:

inspecting the edges for burr edges and knife edges;

providing a substitute suction leaf plate;

stamping in the additional suction leaf plate the slot, wherein the slot is modified to have a width selectively widened at the locations of the burr edges and selectively narrowed at the locations of the knife edges;

tumbling the substitute suction leaf plate in abrasive media;

inspecting the edges of the additional suction leaf plate for burr edges and knife edges;

repeating the above steps until a suction leaf plate is produced having the substantially uniform finish around the edges.

16. The method of claim 12, wherein producing the slot comprises die stamping the slot.

17. The method of claim 12, wherein the abrasive media is substantially granular.

18. A method for manufacturing a suction leaf plate for a reciprocating piston compressor, comprising:

providing a steel plate;

producing a slot in the steel plate to form a suction leaf plate therein, the slot defining a suction leaf valve having a base integral with the suction leaf plate, a tip opposite the base, and edges on the suction leaf valve and the suction leaf plate around the slot, the slot having a width narrowing from a maximum at the base to a minimum at the tip; and tumbling the suction leaf plate in abrasive media to produce a substantially uniform finish around the edges.

19. The method of claim 18, wherein the width of the slot continuously narrows from the base to the tip.

20. The method of claim 18, wherein the substantially uniform finish around the edges is such that each of the edges has a pair of rounded surfaces connected by a planar face.

21. The method of claim 20, further comprising, if the suction leaf plate does not have the substantially uniform finish around the edges, performing the further steps of:

inspecting the edges for burr edges and knife edges;

providing a substitute steel plate;

stamping in the substitute steel plate the slot to form a suction leaf plate, wherein the slot is modified to have a width selectively widened at the locations of the burr edges and selectively narrowed at the locations of the knife edges; and tumbling the additional suction leaf plate in abrasive media;

inspecting the edges of the additional suction leaf plate for burr edges and knife edges; and repeating the above steps until a suction leaf plate is produced having the substantially uniform finish around the edges.

22. The method of claim 18, wherein producing the slot comprises die stamping the slot.

23. The method of claim 18, wherein the abrasive media is substantially granular.

* * * * *